US007549466B2

(12) United States Patent
Hayashi et al.

(10) Patent No.: US 7,549,466 B2
(45) Date of Patent: Jun. 23, 2009

(54) HEAT EXCHANGER

(75) Inventors: Naoto Hayashi, Konan (JP); Ryoichi Kataoka, Konan (JP); Mitsuhiko Akahoshi, Konan (JP); Kiyoshi Tanda, Konan (JP)

(73) Assignee: Valeo Thermal Systems Japan Corporation, Saitama (JP)

( * ) Notice: Subject to any disclaimer, the term of this patent is extended or adjusted under 35 U.S.C. 154(b) by 182 days.

(21) Appl. No.: 11/519,798

(22) Filed: Sep. 13, 2006

(65) Prior Publication Data

US 2007/0062678 A1 Mar. 22, 2007

(30) Foreign Application Priority Data

Sep. 16, 2005 (JP) ..... 2005-269455

(51) Int. Cl.
*F28D 7/06* (2006.01)
*F28F 9/04* (2006.01)

(52) U.S. Cl. ..... 165/176; 165/153; 165/174

(58) Field of Classification Search ..... 165/153, 165/174, 175, 176, DIG. 483
See application file for complete search history.

(56) References Cited

U.S. PATENT DOCUMENTS

| | | | | |
|---|---|---|---|---|
| 5,388,398 | A * | 2/1995 | Kadambi et al. | 165/174 |
| 5,934,367 | A * | 8/1999 | Shimmura et al. | 165/174 |
| 6,199,401 | B1 * | 3/2001 | Haussmann | 165/153 |
| 6,267,173 | B1 * | 7/2001 | Hu et al. | 165/174 |
| 2003/0116310 | A1 | 6/2003 | Wittmann et al. | |

FOREIGN PATENT DOCUMENTS

| | | |
|---|---|---|
| DE | 198 21 095 | 11/1999 |
| EP | 1 199 534 | 4/2002 |
| FR | 2 825 793 | 12/2002 |
| JP | 2001-074388 | 3/2001 |
| JP | 2005-156095 | 6/2005 |

* cited by examiner

*Primary Examiner*—Teresa J Walberg
(74) *Attorney, Agent, or Firm*—Wenderoth, Lind & Ponack, L.L.P.

(57) ABSTRACT

A heat exchanger 1 includes at least a plurality of tubes 2 and an upper tank 4 communicating with an upper end portion of a tube group formed by the tubes 2 so as to distribute coolant along the up/down direction. The coolant flows in through an inflow port 9 located at the upper tank 4 in the heat exchanger 1. An open-top coolant intake guide passage 25 is disposed at the inflow port 9 and the coolant intake guide passage 25 is thus inserted at the upper tank 4. With this configuration, coolant flowing at a very low flow rate has improved distribution, and uniformity in the output air temperature is achieved, while ensuring that the structure does not create excessive resistance against the coolant flow at a high flow rate.

8 Claims, 7 Drawing Sheets

FIG. 1b
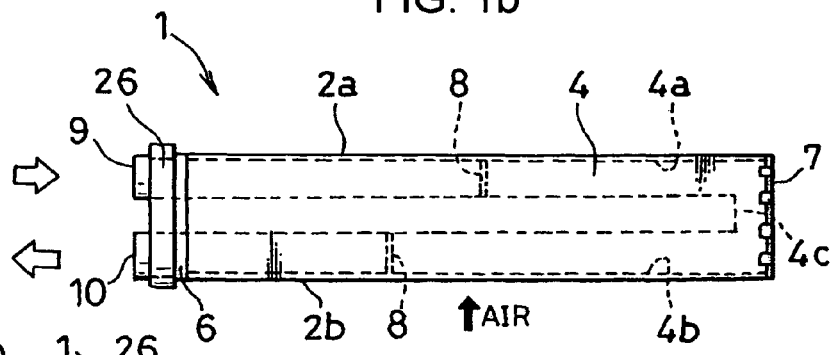
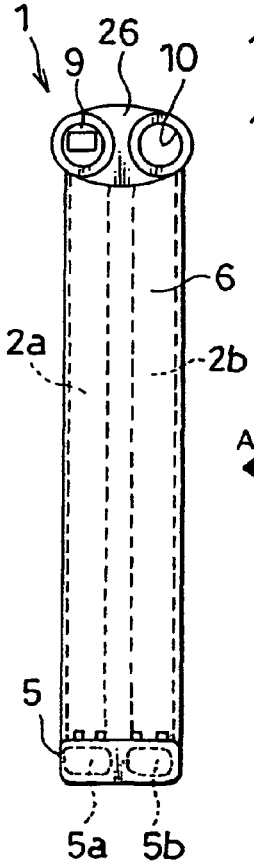
FIG. 1c
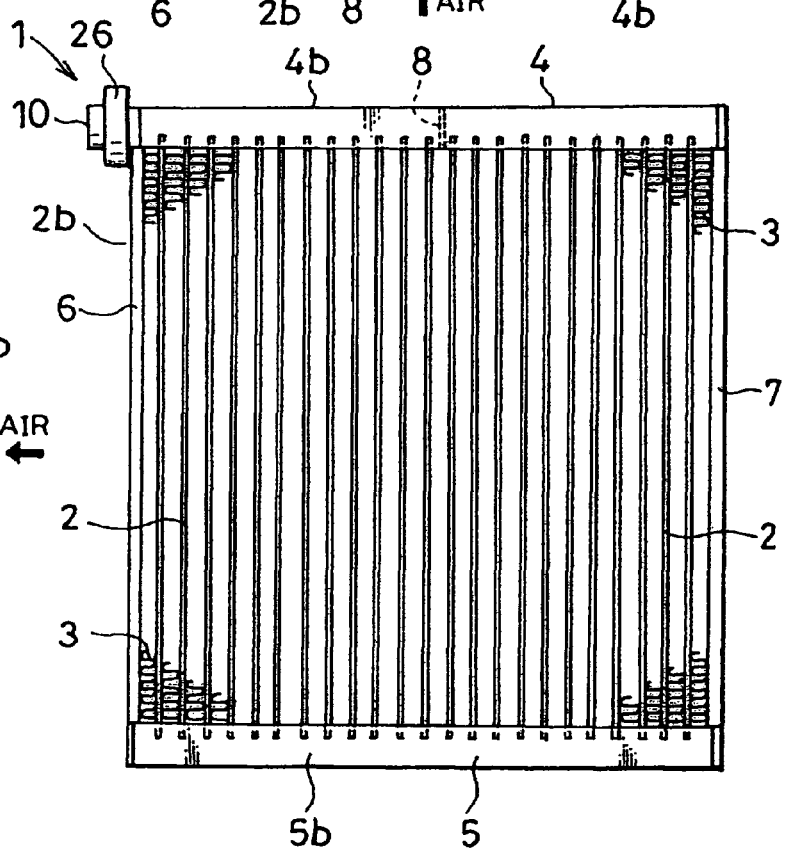
FIG. 1a

FIG. 3a
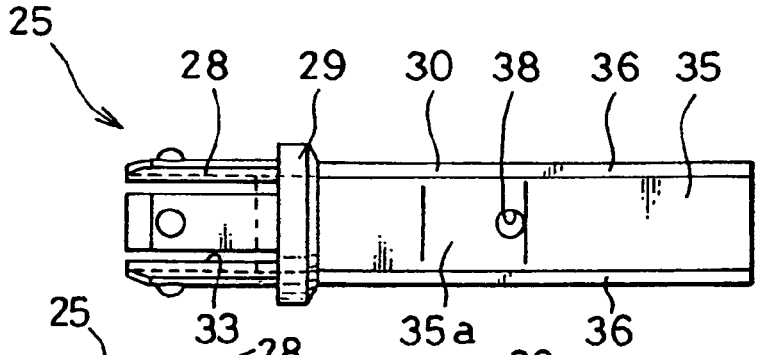
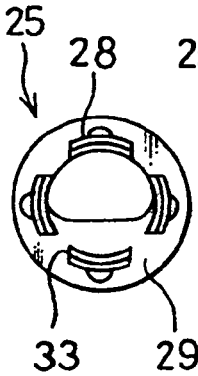
FIG. 3d
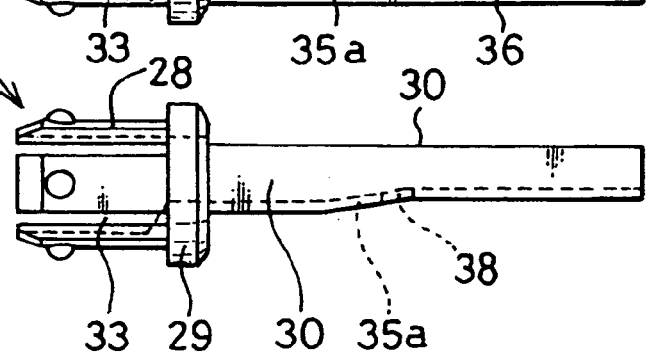
FIG. 3b
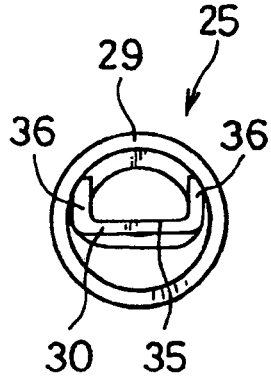
FIG. 3c

HEAT EXCHANGER

CROSS-REFERENCE TO RELATED APPLICATIONS

This application is based upon and claims the benefit of priority from the prior Japanese Patent Application No. 2005-269455, filed on Sep. 16, 2005, the entire contents of which are incorporated herein by reference.

TECHNICAL FIELD

The present invention relates to a heat exchanger such as an evaporator that is used as a component constituting part of a refrigerating cycle and more specifically, it relates to a structure that may be adopted to achieve better temperature distribution uniformity in the heat exchanging unit.

BACKGROUND ART

A heat exchanger known in the related art adopts a four-pass structure that includes a plurality of tubes disposed in two rows, i.e., a front row and a rear row along the direction of airflow, through which a coolant flows along an up/down direction, an upper tank unit and a lower tank unit respectively communicating with the upper ends and the lower ends of the tubes and the like (see patent reference literature 1). (Patent reference literature 1) Japanese Unexamined Patent Publication No. 2001-74388

In the heat exchanger adopting the four-pass structure described above, the liquid coolant flowing through an upper tank unit 100 tends to be distributed in greater quantity to the tubes located on the upstream side along the coolant distribution direction due to gravity, whereas the coolant flowing through lower tank units 101 and 102 tends to be distributed in greater quantity to the tubes located on the downstream side along the coolant distribution direction due to inertia, as shown in FIG. 8*a*. This means that the temperatures over an area in a first pass portion 110 on the side toward a second pass portion, an area B at the second pass portion 111, an area C at a third pass portion 112 and an area D at a fourth pass portion 113 rise readily, since the liquid coolant flow rate over these areas is bound to be low. In particular, the temperature of the output air will rise markedly over an area E (see FIG. 8*b*) over which the first pass portion 110 and the fourth pass portion 113 overlap fore and aft along the direction of airflow. This tendency becomes more pronounced when the coolant flows at a low flow rate. Test results indicate that the temperatures in some of the areas rise as high as 10 to 20° C., adversely affecting temperature control in the cabin.

The problem described above is addressed in the evaporator disclosed in patent reference literature 1 by forming a plurality of restricting holes 51*a* to 56*a* at the lower tank units over the second pass portion and the fourth pass portion so as to adjust the coolant flow rate (see patent reference literature 1). However, the cost of the heat exchanger disclosed in patent reference literature 1 adopting a complicated structure in the tanks is bound to increase significantly.

In addition, an inflow port 9 formed at an evaporator-side intake connector is constricted and the inflow port 9 is set on the upper side along the height of the tanks so as to specifically improve the distribution of the coolant flowing at a low flow rate in the heat exchanger disclosed in patent reference literature 2. However, this structural feature cannot be utilized to full advantage at a very low flow rate, e.g., at the full destroke setting in an air-conditioning system that employs a variable-displacement compressor. Furthermore, at the full capacity setting (maximum flow rate), another problem occurs in that a great deal of resistance is created at the constriction. (Patent reference literature 2) Japanese Unexamined Patent Publication No. 2005-156095

SUMMARY OF THE INVENTION

An object of the present invention is to provide a heat exchanger with which the distribution of coolant flowing at an extremely low flow rate can be improved, uniformity in the output air temperature can be achieved and the coolant can flow in a sufficient quantity without the heat exchanger structure creating an unwanted resistance at a high flow rate, while minimizing the increase in production costs.

The object described above is achieved in the present invention by providing a heat exchanger comprising at least a plurality of tubes disposed so as to distribute a coolant along an up/down direction and an upper tank communicating with an upper end portion of a tube group constituted with the tubes, with coolant flowing in through an inflow port located at the upper tank, characterized in that a coolant intake guide passage with an open top is disposed at the inflow port and that the coolant intake guide passage is inserted at the upper tank.

The coolant having flowed in through the inflow port in the heat exchanger flows into the coolant intake guide passage, travels down to the lower area inside the heat exchanger and is distributed to the individual tubes. Since the coolant intake guide passage is inserted so as to reach a middle area of the upper tank along the lengthwise direction, the coolant is distributed uniformly. Even when the flow rate is very low, the coolant, flowing through the coolant intake guide passage is allowed to travel to the middle area of the tank. In addition, when the coolant flow rate is set high, the coolant overflows through the open top before it reaches the front end of the coolant intake guide passage and flows into the upper tank. Thus, the coolant does not need to flow against a significant resistance at the coolant intake guide passage and uniform distribution is assured.

It is desirable that the inflow port be formed at a heat exchanger-side intake/outlet connector and that the inflow port include a circular portion and an elongated hole with a rectangular section formed at the circular portion toward the heat exchanger with the elongated hole set higher than the center of the circular portion. By adopting this structure, an erroneous assembly of the coolant intake guide passage is prevented. In addition, the coolant intake guide passage includes an intake pipe-side connector insertion portion, a clamped portion and an open-top flow passage portion. The top surface of the open-top flow passage portion is cut off so as to open up the top thereof.

In addition, it is desirable to constitute the coolant intake guide passage by using resin. The coolant intake guide passage is mounted by clamping the clamped portion between a heat exchanger-side intake connector and an intake pipe-side connector linked with the heat exchanger-side intake connector. Namely, the coolant intake guide passage clamped between the two connectors is held firmly.

Moreover, the intake pipe-side connector insertion portion of the coolant intake guide passage is flexible so as to allow the coolant intake guide passage to be inserted at the intake pipe with ease. The flexibility of the intake pipe-side connector insertion portion is achieved by forming a slit at a cylindrical portion thereof along the axial direction. It is desirable that the clamped portion at the coolant intake guide passage be formed as a collar and that the open-top flow passage portion be formed as a trough with an open top.

It is also desirable that the open-top flow passage portion of the coolant intake guide passage be formed at a position offset upward relative to the center of the intake pipe-side connector insertion portion, so as to distribute the coolant further into the tank. In addition, it is desirable that the bottom surface of the open-top flow passage portion of the coolant intake guide passage include an inclined surface midway to the front end thereof so as to offset the front end upward, thereby also ensuring that the coolant is allowed to travel further into the tank.

A hole may be formed at the bottom surface of the open-top flow passage portion of the coolant intake guide passage. It is desirable that the hole be formed at the inclined portion of the bottom surface, so as to distribute the coolant in an optimal quantity uniformly over the area of the upper tank on the closer side.

As described above, the coolant intake guide passage disposed in the inflow port is inserted into the tank so as to allow the coolant to flow to the middle area of the tank via the coolant intake guide passage even when the coolant flow rate is very low. As a result, the coolant distribution is improved and better uniformity in the temperature distribution is achieved at the heat exchanger according to the present invention. In addition, when the coolant flow rate is high, the coolant overflows through the open top into the tank before it reaches the front, thereby achieving another advantage in that the coolant does not need to flow against significant resistance at the coolant intake guide passage.

BRIEF DESCRIPTION OF THE DRAWINGS

FIG. 1*a* is a front view, FIG. 1*b* is a top view, and FIG. 1*c* is a side elevation view of a heat exchanger achieved in an embodiment of the present invention.

FIG. 3*a* is a top view, FIG. 3*b* is a front view, FIG. 3*c* is a right side elevation view, and FIG. 3*d* is a left side elevation view of a coolant intake guide passage disposed at an inflow port of the heat exchanger according to the present invention.

DETAILED DESCRIPTION OF THE INVENTION

Figure 2:
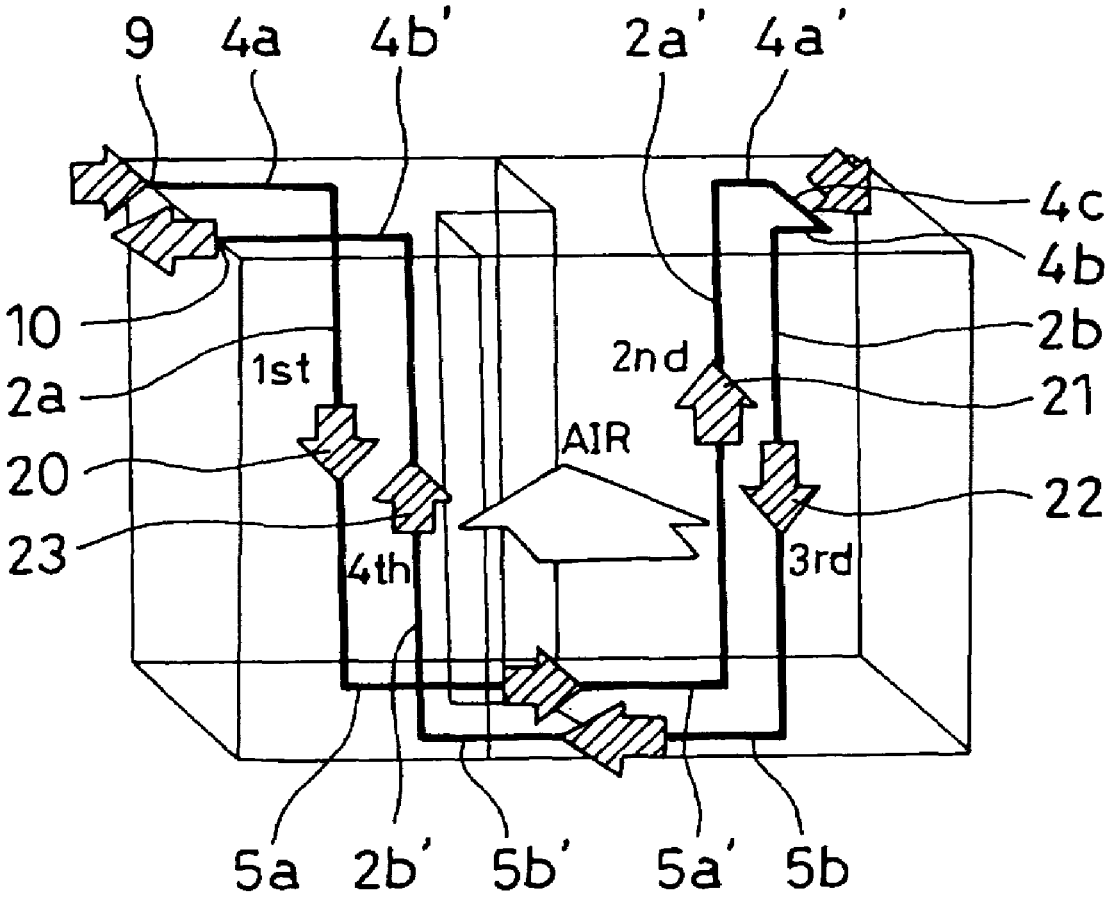
FIG. 2 shows a flow of coolant in the heat exchanger achieved in the embodiment of the present invention.

The following is an explanation of embodiments of the present invention, given in reference to the drawings.

Embodiment 1

A heat exchanger 1 in FIG. 1, achieved in an embodiment of the present invention, is used as an evaporator constituting part of a refrigerating cycle. It includes tubes 2, fins 3, an upper tank 4, a lower tank 5, endplates 6 and 7, partitioning plates 8, an inflow port 9 and an outflow port 10.

The tubes 2 are formed in a flat shape with a hollow space enclosed therein by using a base material the main constituent of which is aluminum. They are disposed over a plurality of rows so as to distribute the coolant along the up/down direction, with tubes disposed in two rows, i.e., a front row and a rear row along the direction of airflow. The tubes 2 include a first tube group 2*a* of tubes disposed in the row toward the downstream side along the airflow direction and a second tube group 2*b* of tubes disposed in the row toward the upstream side along the airflow direction. Corrugated fins 3 constituted of a base material the main constituent of which is aluminum are held between the tubes 2, and the end plates 6 and 7 each constituted with a metal plate or the like are fixed at the two ends of the layered assembly of the tubes 2 and the fins 3 along the layering direction.

The upper tank 4 communicates with the upper ends of the tubes 2, and includes a first upper tank portion 4*a* formed on the downstream side along the airflow direction, a second upper tank portion 4*b* formed on the upstream side along the airflow direction and a communicating passage 4*c* that communicates between the first upper tank portion 4*a* and the second upper tank portion 4*b* at ends on the side opposite from the side where the inflow port 9 and the outflow port 10 are present. The first upper tank portion 4*a* communicates with the first tube group 2*a*, whereas the second upper tank portion 4*b* communicates with the second tube group 2*b*.

The lower tank 5 communicates with the lower ends of the tubes 2, and includes a first lower tank portion 5*a* formed on the downstream side along the airflow direction and a second lower tank portion 5*b* formed on the upstream side along the airflow direction, without the first lower tank portion 5*a* and the second lower tank portion 5*b* communicating with each other. The first lower tank portion 5*a* communicates with the first tube group 2*a*, whereas the second lower tank portion 5*b* communicates with the second tube group 2*b*.

Partitioning plates 8 partition the first upper tank portion 4*a* and the second upper tank portion 4*b* at substantially central points thereof.

The inflow port 9, through which a depressurized liquid coolant is guided in the refrigerated cycle, is formed so as to communicate with the first upper tank portion 4*a*. The outflow port 10, through which the coolant having been circulated through the heat exchanger 1 is guided to an external structure (such as a compressor), is formed so as to communicate with the second upper tank portion 4*b*.

In the heat exchanger structured as described above, the coolant flows through a four-pass flow path, as shown in FIG. 2. Namely, the coolant having flowed in through the inflow port 9 travels from the first upper tank portion 4*a* →the first tube group 2*a*→a first pass portion 20 constituted with the first lower tank portion 5*a* and a first lower tank portion 5*a*'→a first tube group 2*a*'→a second pass portion 21 constituted with a first upper tank portion 4*a*' and the second upper tank portion 4*b*→the second tube group 2*b*→a third pass portion 22 constituted with the second lower tank portion 5*b* and the second lower tank portion 5*b*'→a second tube group 2*b*'→a fourth pass portion 23 constituted with a second upper tank portion 4*b*', and then flows out through the outflow port 10.

Figure 4:
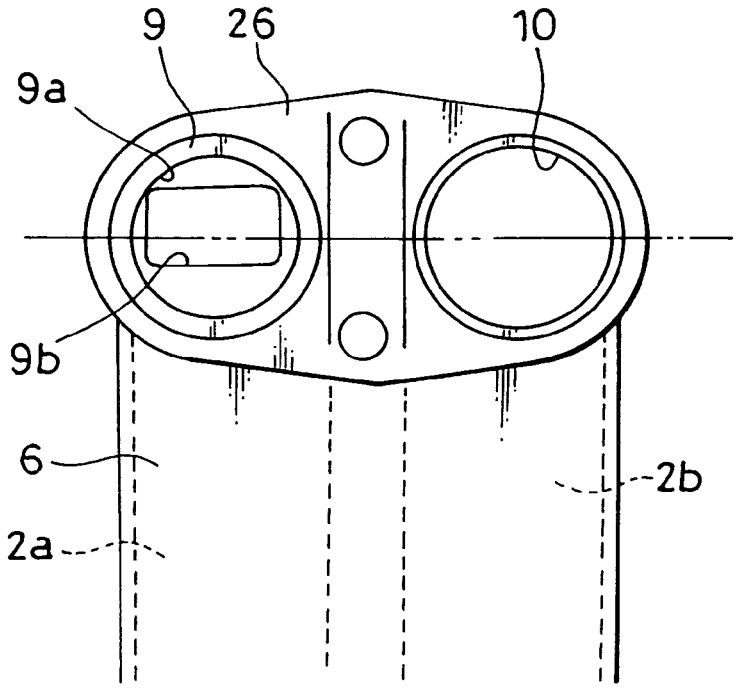
FIG. 4 is a view of the inflow port and an outflow port in the heat exchanger according to the present invention.
Figure 5:
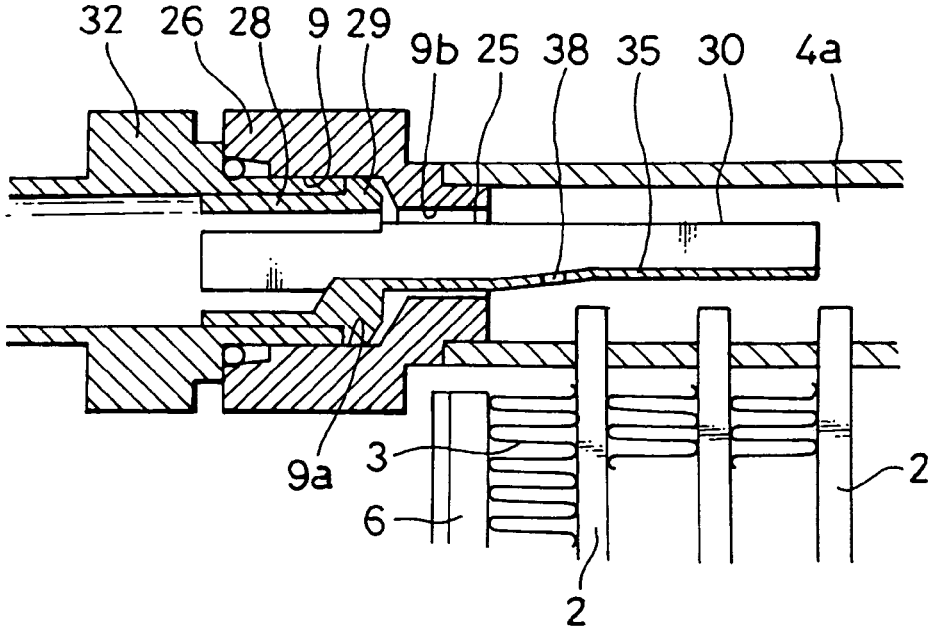
FIG. 5 is a sectional view of the coolant intake guide passage disposed inside the inflow port of the heat exchanger according to the present invention.
Figure 6:
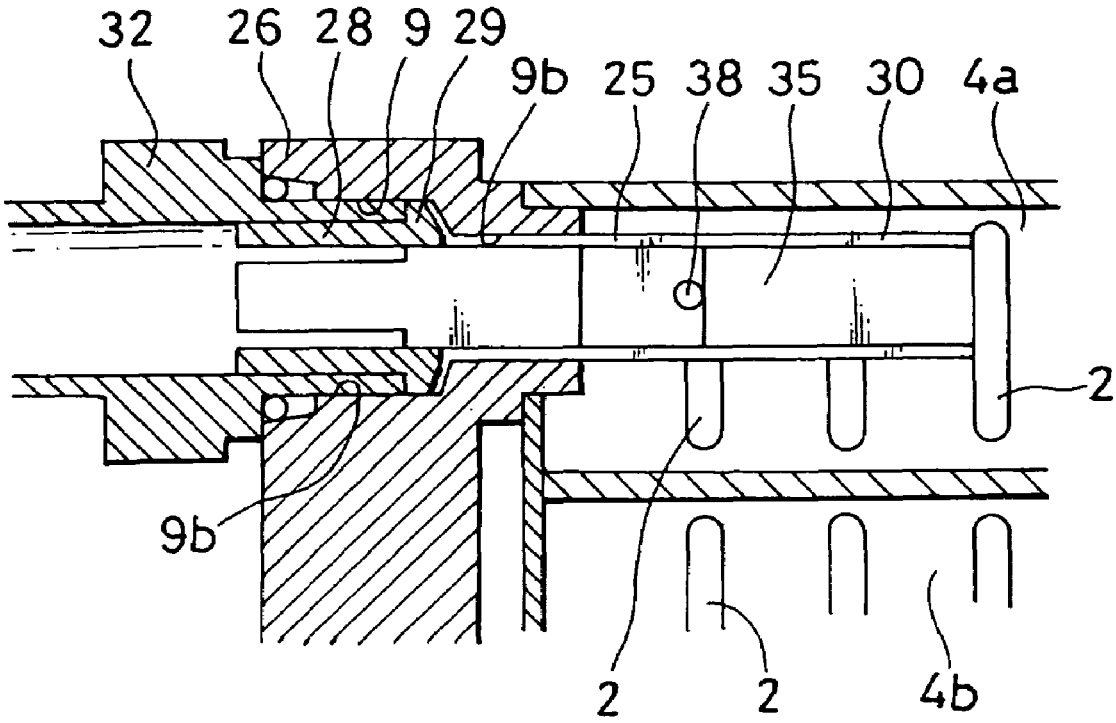
FIG. 6 is a sectional view similar to that in FIG. 5, taken along a different direction.

Next, the structure characterizing the present invention is explained in reference to FIGS. 3*a*-3*d* showing a coolant intake guide passage 25, FIG. 4 showing the intake port 9 and FIGS. 5 and 6 showing the coolant intake guide passage 25 inserted at the inflow port 9. The inflow port 9 is formed at a heat exchanger-side coolant intake/outlet connector 26 and includes a circular hole 9*a* formed further toward the closer side and an elongated hole 9*b* with a rectangular section formed further inward (toward the heat exchanger). The elongated hole 9*b* is formed at a position higher than the center of the circular portion 9*a*.

The coolant intake guide passage 25 includes an intake pipe-side connector insertion portion 28, a clamped portion 29 constituted with a collar and an open-top flow passage portion 30. The intake pipe-side connector insertion portion 28 is inserted at an intake pipe-side connector 32, and a plurality of slits 33 are formed along the axial direction at the intake pipe-side connector insertion portion 28, thereby rendering the intake pipe-side connector insertion portion 28 flexible to allow it to be inserted with ease.

The clamped portion 29 is a collar with a diameter greater than that at the intake pipe-side connector insertion portion 28. It is clamped between the intake pipe-side connector 32 and the heat exchanger-side coolant intake/outlet connector 26 and is disposed inside the inflow port 9 in this state.

The open-top flow passage portion 30, which is a trough-like passage with an open top, includes upright pieces 36 on the two sides of the bottom surface 35 thereof ranging along the lengthwise direction and is offset upward relative to the central point of the intake pipe-side connector insertion portion 28. In addition, the bottom surface 35 includes an inclined surface 35*a* formed midway to the front end thereof, which is made to incline upward, thereby offsetting the front end of the open-top flow passage portion 30 upward.

This structure allows the coolant to travel to the middle area inside the first lower tank portion 5*a*. It is to be noted that since the open-top flow passage portion 30 has an open top, the coolant is allowed to flow into the first lower tank portion 5*a* over the upright pieces 36 at a high flow rate. In addition, a hole 38 is formed at the bottom surface 35 of the open-top flow passage portion 30 so as to distribute the coolant into the first lower tank portion 5*a* located on the closer side. Any number of holes 38 may be formed and such holes 38 should be formed at the inclined surface 35*a*.

Figure 7A:
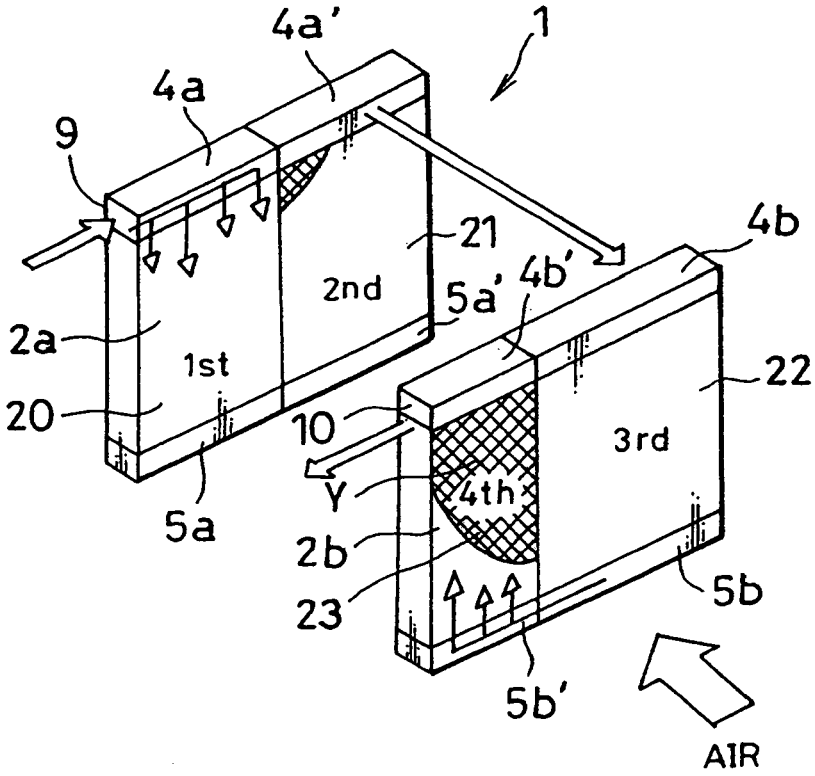
FIG. 7*a* illustrates the characteristics of the coolant flow in the heat exchanger according to the present invention.
Figure 7B:
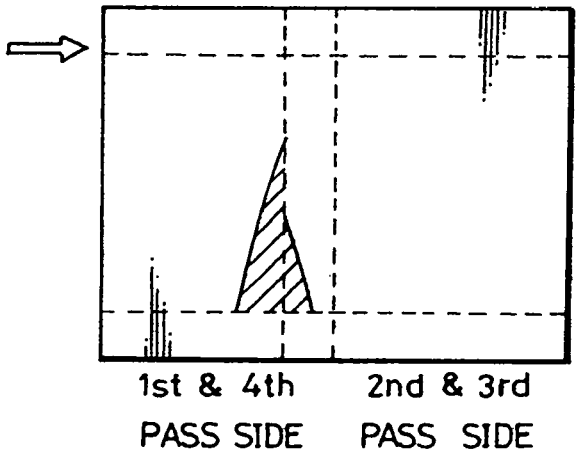
FIG. 7*b* shows the level of uniformity in temperature distribution achieved in the heat exchanger.

Since the coolant intake guide passage 25 is present within the inflow port 9, as described above, the coolant flows in the open-top flow passage portion 30 at the coolant intake guide passage 25, flows in sufficient quantity to the middle area within the first upper tank portion 4*a* through the first pass portion 20 and is distributed substantially evenly into the first tube group 2*a*. As a result, the range of the area at the first pass portion 20 where the temperature rises higher than the temperature over the other area when the coolant flow rate is low is minimized and even though this area partially overlaps a high temperature area Y at the fourth pass portion 23 fore and aft along the airflow direction and a small high temperature area remains, as shown in FIG. 7*b*, uniformity is achieved in the temperature distribution in the overall heat exchanger.

Figure 8A:
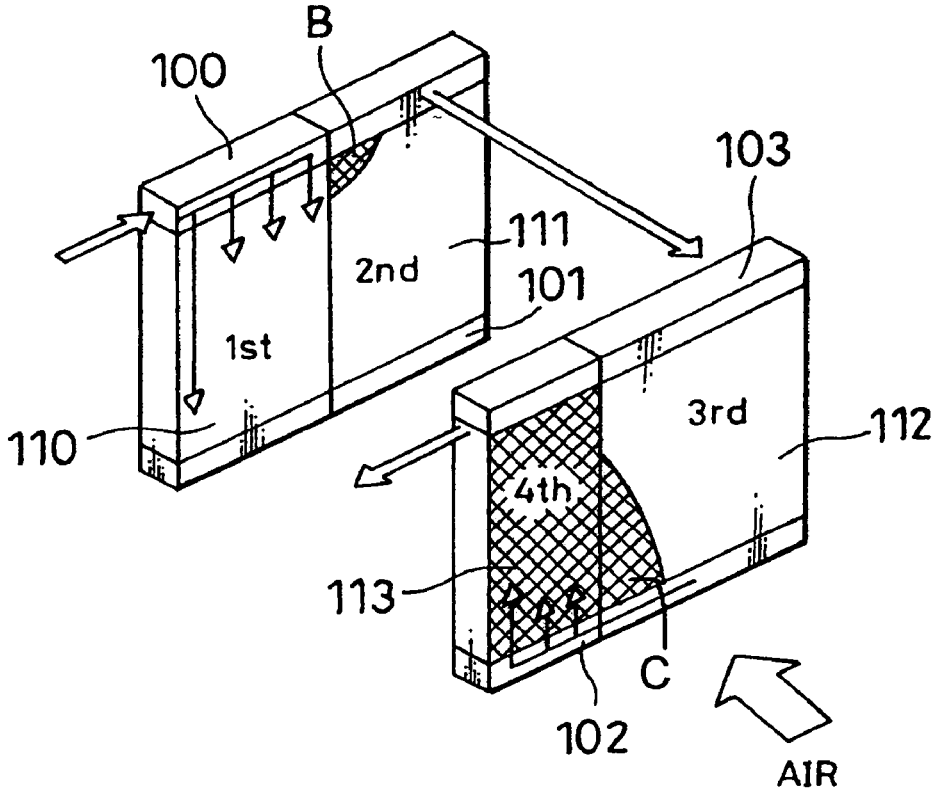
FIG. 8*a* illustrates the characteristics of the coolant flow in a heat exchanger in the related art.
Figure 8B:
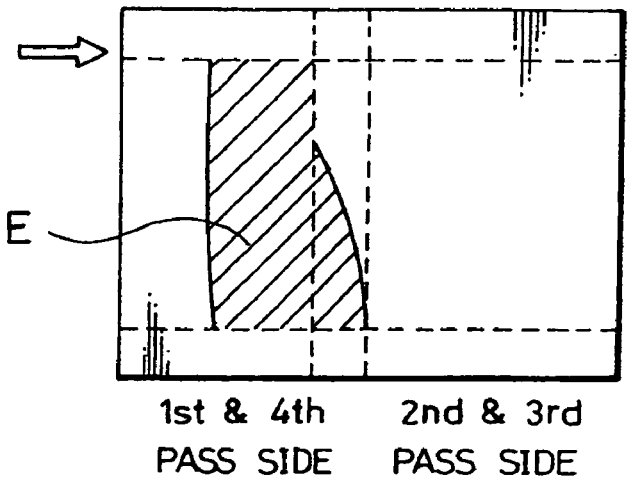
FIG. 8*b* shows the level of uniformity in temperature distribution achieved in the heat exchanger.

The air temperature was measured at 30 leeward positions in the heat exchanger 1. At a low coolant flow rate the air temperatures measured at all the measurement points were invariably equal to or less than 5° C. when the intake air temperature was 35° C. This is a significant improvement over an example of the related art (see FIG. 8*b*) in which the temperatures reached 15 to 20° at a plurality of measurement points.

Embodiment 2

While the present invention is adopted in the four-pass heat exchanger 1 in embodiment 1, it is obvious that the present invention may also be adopted in two-pass heat exchangers. It may be adopted in one-pass heat exchangers as well.

The invention claimed is:

1. An evaporator constituted by a heat exchanger arrangement comprising:

an upper tank having an inflow port through which coolant enters said upper tank to flow in said upper tank along an upper tank lengthwise direction;

a plurality of tubes including a tube group having an upper end portion communicating with said upper tank, said plurality of tubes being configured to distribute the coolant along an up/down direction;

a heat-exchanger side intake/outlet connector, provided at said inflow port of said upper tank, for use in connecting to an intake pipe-side connector; and a coolant intake guide passage provided at least partly in said upper tank at said inflow port;

wherein said coolant intake guide passage includes a flow passage portion configured to receive coolant flowing in the upper tank lengthwise direction from said inflow port and to allow flow of the coolant along the flow passage portion;

wherein said flow passage portion of said coolant intake guide passage is formed as a trough having an open top;

wherein said flow passage portion of said coolant intake guide passage extends, along a lengthwise direction of said upper tank, to a middle portion thereof;

wherein said inflow port includes a circular hole portion and an elongated hole portion connected to said circular hole portion, said elongated hole portion having a substantially rectangular cross section;

wherein said flow passage portion of said coolant intake guide passage is inserted through said elongated hole portion of said inflow port;

wherein said elongated hole portion of said inflow port is disposed on a downstream side of said circular hole portion;

wherein said trough of said flow passage portion of said coolant intake guide passage includes a bottom surface with two upright side walls projecting upwardly from two sides thereof and extending along a lengthwise direction thereof, said trough being configured so that coolant flowing therealong can overflow over said upright side walls at high coolant flow rates;

wherein said coolant intake guide passage is mounted to said heat-exchanger side intake/outlet connector; and wherein said coolant intake guide passage includes an intake pipe-side connector insertion portion for receiving an intake pipe-side connector, and a clamped portion to be clamped between said intake pipe-side connector insertion portion and the intake pipe-side connector, said clamped portion being constituted by a collar larger in diameter than said intake pipe-side connector insertion portion.

2. An evaporator according to claim 1, wherein said tubes are formed with a base material the main constituent of which is aluminum; and wherein said coolant intake guide passage is formed of resin.

3. An evaporator according to claim 2, wherein said coolant intake guide passage is an element separate from said coolant intake/outlet connector and from said upper tank.

4. An evaporator according to claim 2, wherein said intake pipe-side connector insertion portion comprises a cylindrical portion having a slit formed therein along an axial direction thereof, so as to provide said cylindrical portion with flexibility.

5. An evaporator according to claim 1, wherein said coolant intake guide passage is an element separate from said coolant intake/outlet connector and from said upper tank.

6. An evaporator according to claim 1, wherein a center of said elongated hole portion is set higher than a center of said circular hole portion; and said bottom surface of said flow passage portion of said coolant intake guide passage includes an inclined portion, disposed at a middle portion thereof in the lengthwise direction thereof, that is inclined upwardly in a downstream direction such that a downstream end of said bottom surface is offset upwardly from an upstream end thereof.

7. An evaporator according to claim 6, wherein a hole is formed in said bottom surface of said flow passage portion of said coolant intake guide passage at said inclined portion thereof.

8. An evaporator according to claim 1, wherein said intake pipe-side connector insertion portion comprises a cylindrical portion having a slit formed therein along an axial direction thereof, so as to provide said cylindrical portion with flexibility.

* * * * *